US009987860B2

(12) United States Patent
Tabayashi

(10) Patent No.: US 9,987,860 B2
(45) Date of Patent: Jun. 5, 2018

(54) INKJET PRINTER

(71) Applicant: MIMAKI ENGINEERING CO., LTD., Nagano (JP)

(72) Inventor: Isao Tabayashi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days. days.

(21) Appl. No.: 15/318,672

(22) PCT Filed: Jun. 16, 2015

(86) PCT No.: PCT/JP2015/067354
§ 371 (c)(1),
(2) Date: Dec. 14, 2016

(87) PCT Pub. No.: WO2015/194566
PCT Pub. Date: Dec. 23, 2015

(65) Prior Publication Data

US 2017/0129256 A1 May 11, 2017

(30) Foreign Application Priority Data

Jun. 17, 2014 (JP) ..... 2014-123953

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 11/002; B41J 2/2114; B41J 11/0015
USPC ..... 347/21, 102
See application file for complete search history.

(56) References Cited

U.S. PATENT DOCUMENTS

2012/0127249 A1* 5/2012 Mizutaki ..... C09D 11/101 347/102

FOREIGN PATENT DOCUMENTS

| | | |
|---|---|---|
| JP | 2006035688 | 2/2006 |
| JP | 2012040837 | 3/2012 |
| JP | 2012126122 | 7/2012 |
| JP | 2013230599 | 11/2013 |

OTHER PUBLICATIONS

"International Search Report (Form PCT/ISA/210) of PCT/JP2015/067354", dated Jul. 14, 2015, with English translation thereof, pp. 1-4.

* cited by examiner

*Primary Examiner* — Jannelle M Lebron
(74) *Attorney, Agent, or Firm* — JCIPRNET

(57) ABSTRACT

The disclosure provides an inkjet printer capable of reducing yellowing of a coating attributable to clear ink with respect to printing on a print medium with color ink. An inkjet printer (10) having LED lamps (26) for hardening color ink and an ultraviolet lamp (27) for hardening clear ink ejects ultraviolet curing type color ink toward a print medium (90) by inkjet heads (24) for color ink, and radiates ultraviolet light with a wavelength equal to or longer than 365 nm toward the color ink having adhered to the print medium (90) by the LED lamps (26), and ejects ultraviolet curing type clear ink toward the hardened color ink by inkjet heads (25) for clear ink, and radiates ultraviolet light with a wavelength equal to or shorter than 365 nm toward the clear ink having adhered to the color ink by the ultraviolet lamp (27).

15 Claims, 9 Drawing Sheets

INKJET PRINTER

CROSS-REFERENCE TO RELATED APPLICATION

This application is a 371 application of the International PCT application serial no. PCT/JP2015/067354, filed on Jun. 16, 2015, which claims the priority benefits of Japan Patent Application No. 2014-123953, filed on Jun. 17, 2014. The entirety of each of the above-mentioned patent applications is hereby incorporated by reference herein and made a part of this specification.

TECHNICAL FIELD

The disclosure relates to an inkjet printer for performing coating with clear ink with respect to printing on print media with color ink.

BACKGROUND ART

In the related art, there is known an inkjet printer configured to perform coating with clear ink with respect to printing on print media with color ink, and having an inkjet head for color ink configured to eject ultraviolet curing type color ink, an inkjet head for clear ink configured to eject ultraviolet curing type clear ink, and an LED (Light Emitting Diode) lamp for radiating ultraviolet light capable of hardening the color ink and the clear ink (see Patent Literature 1).

The inkjet printer of the related art first ejects the color ink toward a print medium by the inkjet head for color ink such that the color ink adheres to the print medium. Subsequently, the inkjet printer of the related art radiates ultraviolet light toward the color ink having adhered to the print medium by the LED lamp, thereby hardening the color ink. Subsequently, the inkjet printer of the related art ejects the clear ink toward the hardened color ink by the inkjet head for clear ink, such that the clear ink adheres to the color ink. Finally, the inkjet printer of the related art radiates ultraviolet light toward the clear ink having adhered to the color ink by the LED lamp, thereby hardening the clear ink.

CITATION LIST

Patent Literature

Patent Literature 1: JP-A-2006-35688

SUMMARY OF DISCLOSURE

Technical Problem

Ultraviolet light which is radiated by the LED lamp is generally ultraviolet light having a long wavelength such as 385 nm in order to secure the inner curing property of the color ink. For this reason, the absorption wavelength of a photoinitiator which is contained in the clear ink to be hardened by ultraviolet light radiated by the LED lamp needs to be a long wavelength. The clear ink containing the photoinitiator in which the absorption wavelength of the photoinitiator is a long wavelength is likely to yellow in a case where the clear ink is hardened by ultraviolet light. Therefore, the inkjet printer of the related art has a problem that a coating formed by hardening clear ink by ultraviolet light radiated by the LED lamp is likely to yellow.

Therefore, the disclosure provides an inkjet printer capable of reducing yellowing of a coating made of clear ink with respect to printing on print media with color ink, as compared to the related art.

Solution to Problem

An inkjet printer of the disclosure is characterized by including an inkjet head for color ink configured to eject ultraviolet curing type color ink, an inkjet head for clear ink configured to eject ultraviolet curing type clear ink, a lamp for color ink configured to radiate ultraviolet light capable of hardening the color ink, a lamp for clear ink configured to radiate ultraviolet light capable of hardening the clear ink, and a printing controller configured to control printing on a print medium, wherein the printing controller performs a color ink ejecting process of ejecting the color ink toward the print medium by the inkjet head for color ink, a color ink hardening process of radiating ultraviolet light toward the color ink having adhered to the print medium by the color ink ejecting process, by the lamp for color ink, a clear-ink ejecting process of ejecting the clear ink toward the color ink hardened by the color ink hardening process, by the inkjet head for clear ink, and a clear-ink hardening process of radiating ultraviolet light toward the clear ink having adhered to the color ink by the clear-ink ejecting process, by the lamp for clear ink, and the color ink hardening process is a process of hardening the color ink by ultraviolet light with a wavelength equal to or longer than 365 nm radiated toward the color ink by the lamp for color ink, and the clear-ink hardening process is a process of hardening the clear ink by ultraviolet light with a wavelength equal to or shorter than 365 nm radiated toward the clear ink by the lamp for clear ink.

According to this configuration, the inkjet printer of the disclosure hardens the clear ink by ultraviolet light radiated by the lamp for clear ink configured to radiate ultraviolet light capable of hardening the clear ink, not by ultraviolet light radiated by the lamp for color ink configured to radiate ultraviolet light capable of hardening the color ink, and thus can use clear ink containing a photoinitiator sensitive for ultraviolet light having short wavelengths shorter than 365 nm, such as ultraviolet light having short wavelengths such as 254 nm. In a case where this clear ink is hardened by ultraviolet light, it is unlikely to yellow.

Therefore, the inkjet printer of the disclosure can reduce yellowing of a coating formed of the clear ink with respect to printing on the print medium with the color ink.

Also, the inkjet printer of the disclosure may include a moving mechanism configured to relatively move the print medium in a specific direction with respect to the inkjet head for color ink, the inkjet head for clear ink, the lamp for color ink, and the lamp for clear ink, wherein the lamp for clear ink may be disposed on the downstream side from the inkjet head for clear ink in the specific direction, and the printing controller may perform a post-clear-ink-ejection moving process of driving the moving mechanism until the clear ink having adhered to the color ink by the clear-ink ejecting process and the lamp for clear ink come into a state where they face each other, and the clear-ink hardening process may be a process of radiating ultraviolet light toward the clear ink by the lamp for clear ink in a case where the clear ink having adhered to the color ink by the clear-ink ejecting process and the lamp for clear ink have come into a state where they face each other by the post-clear-ink-ejection moving process.

According to this configuration, in the inkjet printer of the disclosure, since the inkjet head for clear ink and the lamp for clear ink are disposed separately in the specific direction, in a period from when the clear ink has adhered to the color ink by the inkjet head for clear ink to when the clear ink is hardened by the lamp for clear ink, it is required a time for moving at least one of the print medium and the lamp for clear ink such that the clear ink having adhered to the color ink by the inkjet head for clear ink and the lamp for clear ink come into a state where they face each other. For this reason, during this movement time, the leveling property of the clear ink having adhered to the color ink improves. Therefore, the inkjet printer of the disclosure can improve the glossiness of the coating formed of the clear ink with respect to printing on the print medium with the color ink.

Also, the inkjet printer of the disclosure may include a carriage movable in a direction intersecting with the specific direction, wherein the inkjet head for color ink, the inkjet head for clear ink, and the lamp for color ink may be mounted on the carriage, and the color ink hardening process is a process of radiating ultraviolet light toward the color ink having adhered to the print medium by the color ink ejecting process, by the lamp for color ink, when the carriage performs scanning for the color ink ejecting process in the direction intersecting with the specific direction.

According to this configuration, since the inkjet printer of the disclosure immediately hardens the color ink having adhered to the print medium by the color ink ejecting process, by the color ink hardening process, it is possible to suppress bleeding of the color ink. Therefore, the inkjet printer of the disclosure can improve the glossiness of the coating formed of the clear ink with respect to printing on the print medium with the color ink while suppressing bleeding during printing on the print medium with the color ink.

Also, in the inkjet printer of the disclosure, the lamp for color ink may be an LED lamp.

According to this configuration, as compared to a case where the lamp for color ink is, for example, a high-pressure mercury lamp, a metal halide lamp, or the like, the inkjet printer of the disclosure can reduce the weight of the lamp for color ink. Therefore, the inkjet printer of the disclosure can reduce the size of a drive device for moving the carriage having the lamp for color ink mounted thereon, and can reduce the size of the whole of the inkjet printer.

Also, in the inkjet printer of the disclosure, the color ink hardening process may be a process of hardening the color ink by ultraviolet light with a wavelength equal to or shorter than 385 nm radiated toward the color ink by the lamp for color ink.

According to this configuration, in the inkjet printer of the disclosure, since the color ink contains a photoinitiator sensitive for ultraviolet light with wavelengths equal to or longer than 385 nm, the color ink is likely to yellow. However, since the color ink has a color from the beginning, its yellowing is more inconspicuous as compared to the clear ink. Therefore, even if the inkjet printer of the disclosure has an LED lamp configured to radiate ultraviolet light with a wavelength equal to or longer than 385 nm as the lamp for color ink, it is possible to suppress deterioration in the quality of printing using the color ink.

Also, in the inkjet printer of the disclosure, the lamp for clear ink may be a high-pressure mercury lamp or a metal halide lamp, and the clear-ink hardening process may be a process of hardening the clear ink by ultraviolet light with a wavelength equal to or shorter than 320 nm radiated toward the clear ink by the lamp for clear ink.

According to this configuration, in the inkjet printer of the disclosure, since the clear ink contains the photoinitiator sensitive for ultraviolet light with wavelengths equal to or shorter than 320 nm, and from among a plurality of peaks with the wavelength of ultraviolet light which is radiated by the high-pressure mercury lamp or the metal halide lamp which is used as the lamp for clear ink, peaks with a wavelength equal to or shorter than 320 nm is used to harden the clear ink, it is possible to reduce yellowing of the coating formed of the clear ink with respect to printing on the print medium with the color ink.

Also, in the inkjet printer of the disclosure, the lamp for clear ink may extend in the direction intersecting with the specific direction, over a width equal to or longer than the width of the clear ink which adheres to the color ink by the clear-ink ejecting process.

In the inkjet printer of the disclosure, in case of a configuration for moving the lamp for clear ink in the direction intersecting with the specific direction, with respect to the print medium, over a width equal to or longer than the width of the clear ink which adheres to the color ink by the clear-ink ejecting process, since portions which are included in the clear ink having adhered to the color ink and toward which ultraviolet light is intensively radiated by the lamp for clear ink, that is, portions which are quickly hardened move with movement of the lamp for clear ink relative to the print medium in the direction intersecting with the specific direction, movement of the lamp for clear ink causes optical stripes on the clear ink having adhered to the color ink. However, in a case where the inkjet printer of the disclosure has a configuration in which the lamp for clear ink extends in the direction intersecting with the specific direction over a width equal to or longer than the width of the clear ink which adheres to the color ink by the clear-ink ejecting process, since it is unnecessary to move the lamp for clear ink with respect to the print medium in the direction intersecting with the specific direction, it is possible to suppress optical stripes from being generated on the clear ink having adhered to the color ink. Therefore, in the case where the inkjet printer of the disclosure has a configuration in which the lamp for clear ink extends in the direction intersecting with the specific direction over a width equal to or longer than the width of the clear ink which adheres to the color ink by the clear-ink ejecting process, it is possible to improve the glossiness of the coating formed of the clear ink with respect to printing on the print medium with the color ink.

Also, in the inkjet printer of the disclosure, the color ink hardening process may be a process of temporarily hardening the color ink by radiating ultraviolet light toward the color ink having adhered to the print medium by the color ink ejecting process, by the lamp for color ink, and the clear-ink hardening process may be a process in which not only the clear ink is hardened, the color ink is completely hardened by radiating ultraviolet light toward the clear ink having adhered to the color ink by the clear-ink ejecting process, by the lamp for clear ink.

According to this configuration, since the inkjet printer of the disclosure needs only to temporarily harden the color ink by the lamp for color ink, as compared to a configuration for completely hardening the color ink by the lamp for color ink, it is possible to reduce the accumulated amount of ultraviolet light which the lamp for color ink radiates toward the color ink. Therefore, as compared to the configuration for completely hardening the color ink by the lamp for color ink, the inkjet printer of the disclosure can reduce a time which is required for the lamp for color ink to radiate ultraviolet light toward the color ink, thereby reducing a total time for printing using the color ink and the clear ink, and reduce the intensity of ultraviolet light which the lamp for color ink radiates toward the color ink, thereby saving electric power.

Advantageous Effects of Disclosure

The inkjet printer of the disclosure can reduce yellowing of a coating formed of the clear ink with respect to printing on a print medium with the color ink, as compared to the related art.

BRIEF DESCRIPTION OF DRAWINGS

FIG. 5(*b*) is a cross-sectional view of the area of the print medium shown in FIG. 5(*a*) in a case where a color ink hardening process is being performed. FIG. 5(*c*) is a cross-sectional view of the area of the print medium shown in FIG. 5(*b*) in a case where a clear-ink ejecting process is being performed. FIG. 5(*d*) is a cross-sectional view of the area of the print medium shown in FIG. 5(*c*) in a case where a clear-ink hardening process is being performed.

DESCRIPTION OF EMBODIMENTS

Hereinafter, embodiments of the disclosure will be described with reference to drawings.

First, the configuration of an inkjet printer according to an embodiment of the disclosure will be described.

Figure 1:
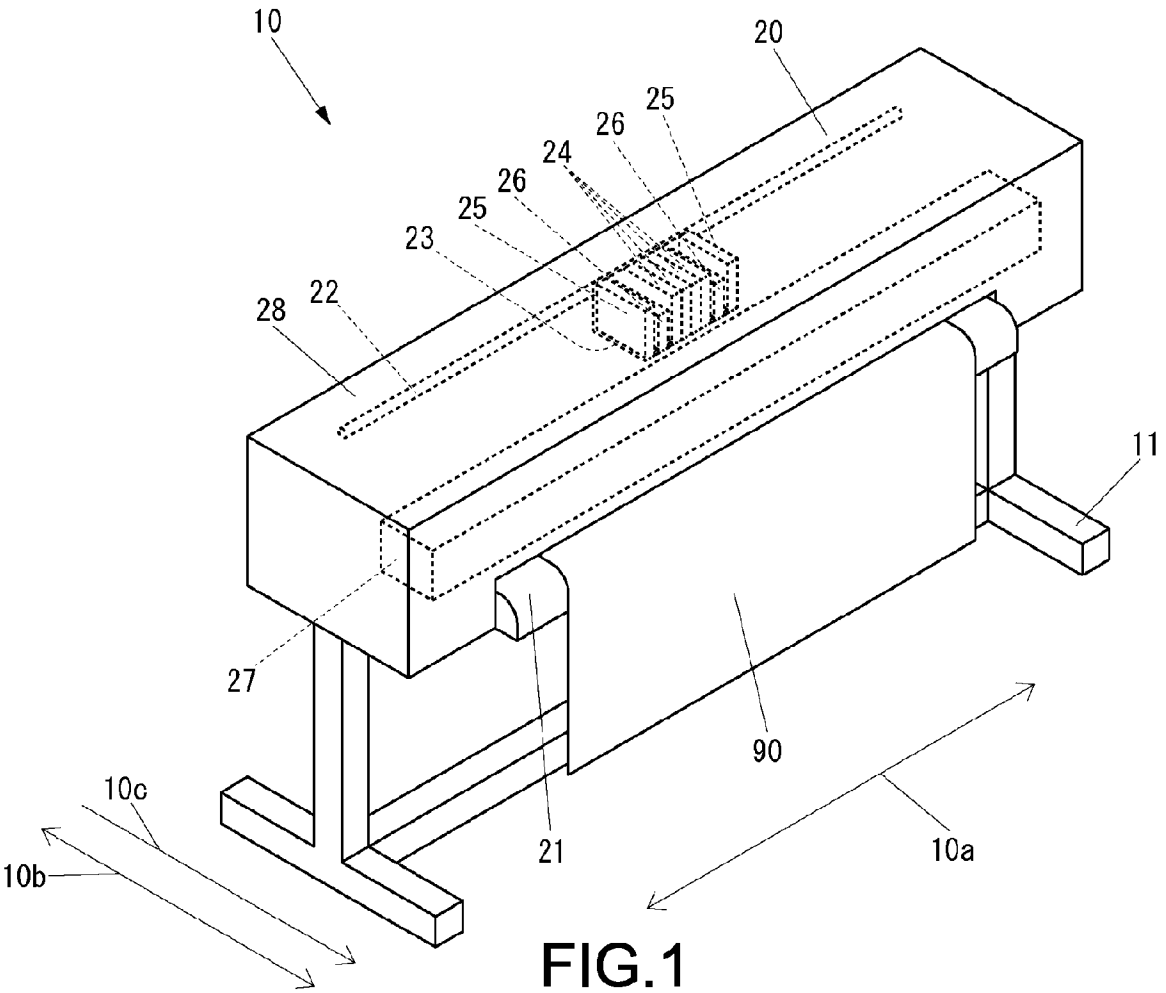
FIG. 1 is a perspective view illustrating the external appearance of an inkjet printer according to an embodiment of the disclosure.

FIG. 1 is a perspective view illustrating the external appearance of an inkjet printer 10 according to the present embodiment.

As shown in FIG. 1, the inkjet printer 10 includes a leg part 11 which is installed on a floor, and a main body 20 supported on the leg part 11 and extending in main scan directions shown by an arrow 10*a*.

Figure 2:
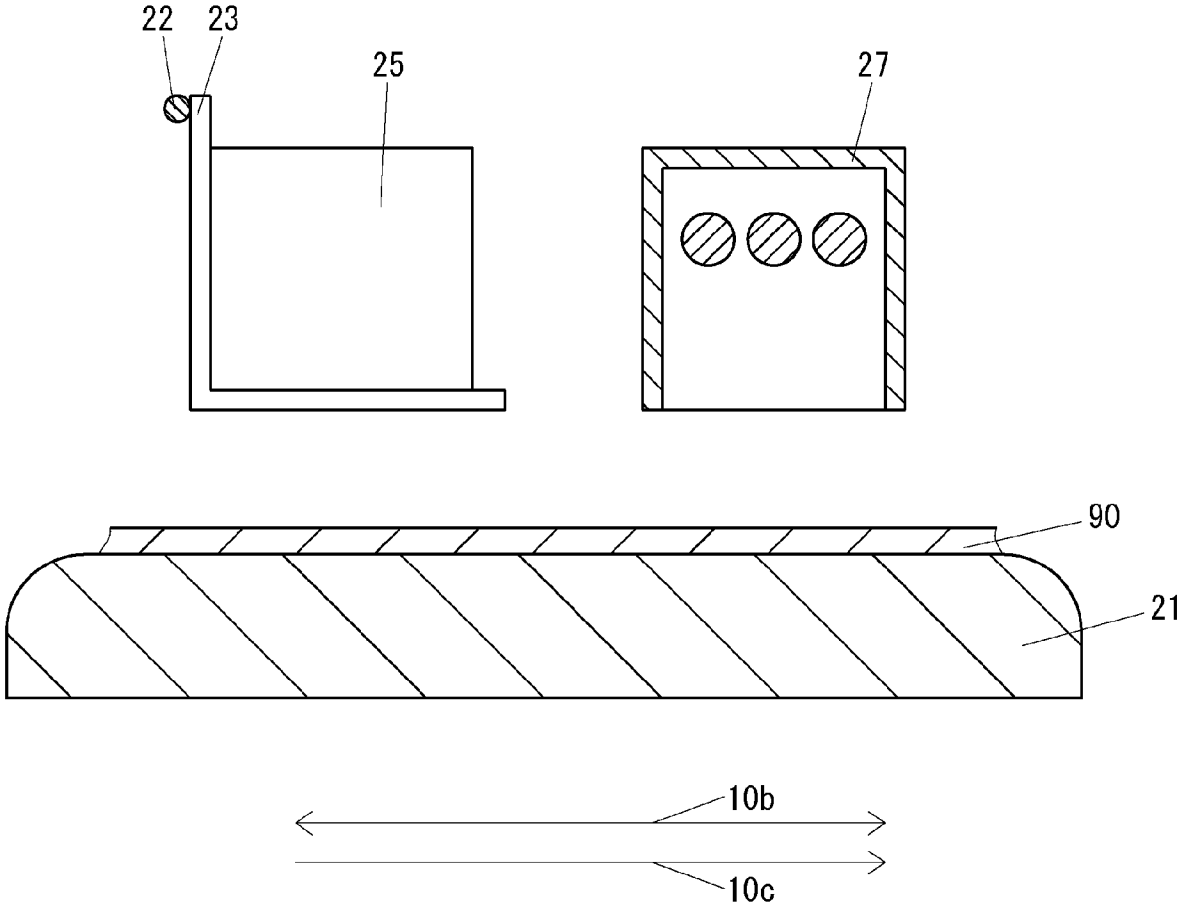
FIG. 2 is a sectional side view of a portion of the inkjet printer shown in FIG. 1.
Figure 3:
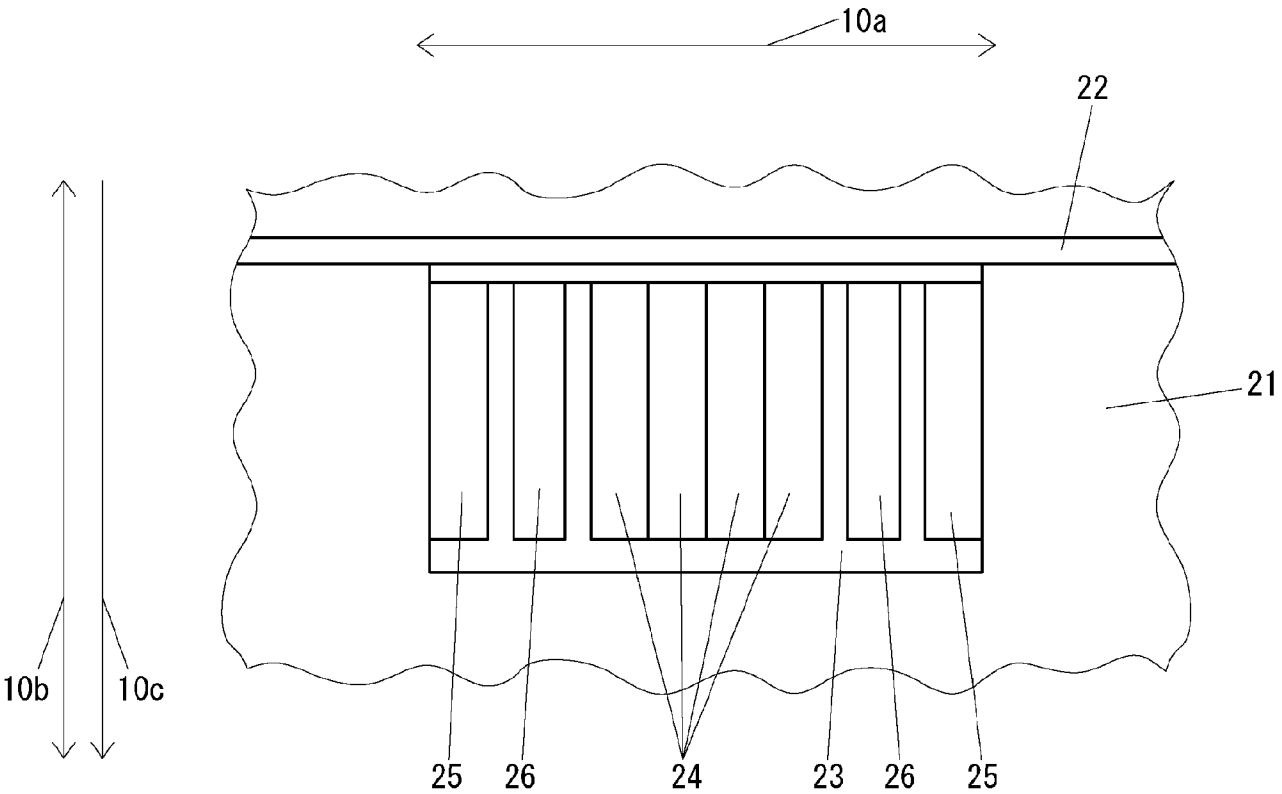
FIG. 3 is a plan view of a portion of the inside of a main body of the inkjet printer shown in FIG. 1.

FIG. 2 is a sectional side view of a portion of the inkjet printer 10. FIG. 3 is a plan view of a portion of the inside of the main body 20 of the inkjet printer 10.

As shown in FIG. 1 to FIG. 3, the main body 20 includes a medium conveyance device 21 for conveying print media 90 in a sub san direction shown by an arrow 10*b* and perpendicular to the main scan directions shown by the arrow 10*a*, a guide rail 22 extending in the main scan directions, a carriage 23 supported on the guide rail 22 so as to be movable in the main scan directions, a plurality of inkjet heads 24 for color ink mounted on the carriage 23 and configured to eject ultraviolet curing type color ink toward each print medium 90, two inkjet heads 25 for clear ink mounted on the carriage 23 and configured to eject ultraviolet curing type clear ink toward each print medium 90, two LED lamps 26 which are lamps for color ink mounted on the carriage 23 and configured to radiate ultraviolet light, an ultraviolet lamp 27 which is a lamp for clear ink extending in the main scan directions and configured to radiate ultraviolet light, and a case 28 configured to cover the guide rail 22, the carriage 23, the plurality of inkjet heads 24 for color ink, the two inkjet heads 25 for clear ink, the two LED lamps 26, and the ultraviolet lamp 27.

The medium conveyance device 21 is configured to relatively move each print medium 90 in a direction which is shown by an arrow 10*c* and is one of the sub san directions shown by the arrow 10*b*, with respect to the plurality of inkjet heads 24 for color ink, the two inkjet heads 25 for clear ink, the two LED lamps 26, and the ultraviolet lamp 27, and constitutes a moving mechanism of the disclosure.

The inkjet heads 24 for color ink can eject the color ink toward each print medium 90 from each of a plurality of nozzles disposed side by side in the sub san directions shown by the arrow 10*b* and not shown in the drawing. The plurality of inkjet heads 24 for color ink is disposed side by side in the main scan directions shown by the arrow 10*a*.

As the color ink which is ejected by the inkjet heads 24 for color ink, a variety of color ink can be used. For example, cyan ink, magenta ink, yellow ink, black ink, white ink, and the like can be used as the color ink. The color ink which is ejected by the inkjet heads 24 for color ink contains a photoinitiator which generates radicals by ultraviolet light belonging to the long-wavelength side (wavelengths equal to or longer than 365 nm), that is, a photoinitiator sensitive for ultraviolet light having long wavelengths equal to or longer than 365 nm.

The inkjet heads 25 for clear ink can eject the clear ink toward each print medium 90 from each of a plurality of nozzles disposed side by side in the sub san directions shown by the arrow 10*b* and not shown in the drawing. The two inkjet heads 25 for clear ink are disposed on both sides of the plurality of inkjet heads 24 for color ink in the main scan directions shown by the arrow 10*a*.

The clear ink which is ejected by the inkjet heads 25 for clear ink is ink containing no pigment. The clear ink which is ejected by the inkjet heads 25 for clear ink contains a photoinitiator which generates radicals by ultraviolet light belonging to the short-wavelength side (wavelengths shorter than 365 nm), that is, a photoinitiator sensitive for ultraviolet light having short wavelengths shorter than 365 nm.

The LED lamps 26 are for radiating ultraviolet light capable of hardening the color ink ejected by the inkjet heads 24 for color ink. As the wavelength of ultraviolet light which is radiated by each LED lamp 26, for example, arbitrary wavelengths from 365 nm to 410 nm can be used. Here, it is more preferable that the wavelength of ultraviolet light which is radiated by each LED lamp 26 be equal to or longer than 385 nm. The radiant outputs of the LED lamps 26 are, for example, 5 W/cm or less. The two LED lamps 26 are disposed on both sides of the plurality of inkjet heads 24 for color ink in the main scan directions shown by the arrow 10*a*, so as to be interposed between the two inkjet heads 25 for clear ink.

The ultraviolet lamp 27 is for radiating ultraviolet light capable of hardening the clear ink ejected by the inkjet heads 25 for clear ink. The wavelength band of ultraviolet light which is radiated by the ultraviolet lamp 27 needs to be a band of wavelengths shorter than the wavelengths of ultraviolet light which is radiated by the LED lamps 26, and for example, a band of wavelengths equal to or longer than 200 nm and shorter than 365 nm can be used. The radiant output of the ultraviolet lamp 27 is, for example, 50 W/cm or greater. The ultraviolet lamp 27 is a straight tube type lamp extending over a width equal to or longer than the width of the clear ink which adheres to color ink by the clear-ink ejecting process to be described below, in directions intersecting with the direction shown by the arrow 10*c*, that is, in the main scan directions shown by the arrow 10*a*. As the ultraviolet lamp 27, a lamp other than LED lamps, such as a high-pressure mercury lamp or a metal halide lamp, can be used. The ultraviolet lamp 27 is disposed on the downstream side from the inkjet heads 25 for clear ink in a specific direction, that is, in the direction shown by the arrow 10*c*.

Figure 4:
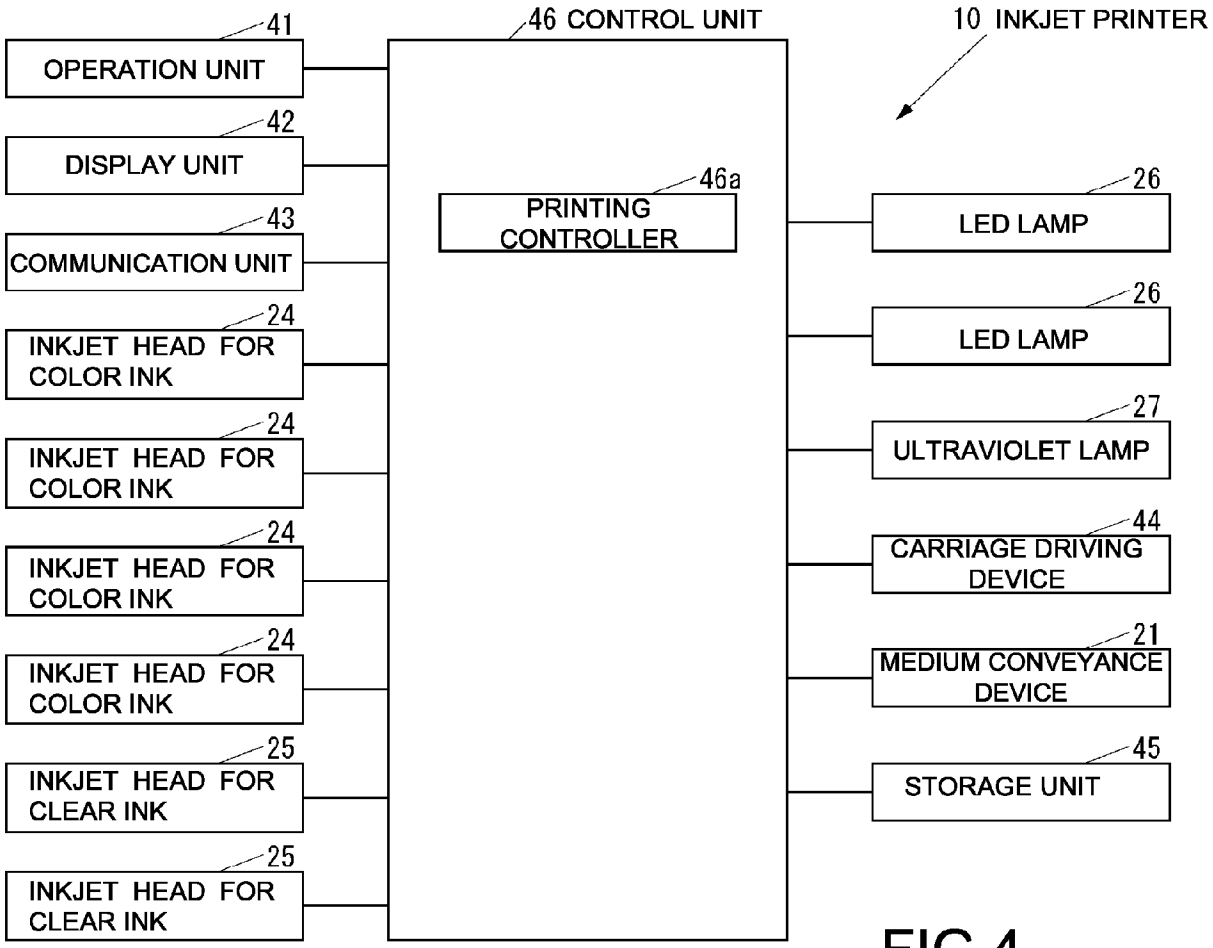
FIG. 4 is a block diagram of the inkjet printer shown in FIG. 1.
Figure 5A:
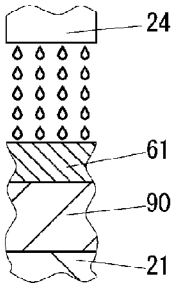
FIG. 5(*a*) is a cross-sectional view of a specific area of a print medium shown in FIG. 1 in a case where a color ink ejecting process is being performed.
Figure 5B:
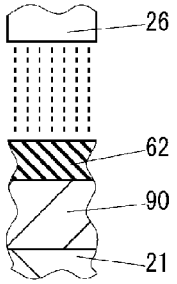
Figure 5C:
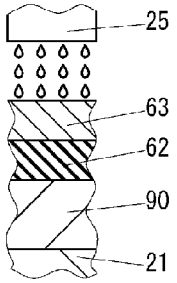
Figure 5D:
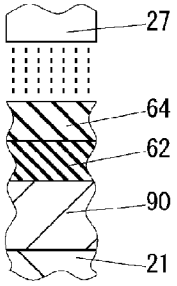

FIG. 4 is a block diagram of the inkjet printer 10.

As shown in FIG. 4, the inkjet printer 10 includes an operation unit 41 which is an input device such as buttons for inputting various operations, a display unit 42 which is a display device such as an LCD (Liquid Crystal Display) for displaying a variety of information, a communication unit 43 which is a communication device for performing communication with external devices such as a PC (Personal Computer), the plurality of inkjet heads 24 for color ink described above, the two inkjet heads 25 for clear ink described above, the two LED lamps 26 described above, the ultraviolet lamp 27 described above, a carriage driving device 44 for moving the carriage 23 (see FIG. 1) along the guide rail 22 (see FIG. 1) in the main scan directions shown by the arrow 10*a* (see FIG. 1), the medium conveyance device 21 described above, a storage unit 45 which is a storage device such as an EEPROM (Electrically Erasable Programmable Read Only Memory) for storing a variety of data, and a control unit 46 for controlling the whole of the inkjet printer 10.

The control unit 46 includes, for example, a CPU (Central Processing Unit), a ROM (Read Only Memory) retaining programs and a variety of data in advance, and a RAM (Random Access Memory) usable as a work area for the CPU. The CPU is configured to execute programs stored in the ROM or the storage unit 45.

The control unit 46 executes programs stored in the ROM and the storage unit 45, thereby functioning as a printing controller 46*a* for controlling printing on print media 90.

Now, an operation of the inkjet printer 10 will be described.

If receiving print data transmitted from the outside through the communication unit 43, the printing controller 46*a* of the control unit 46 of the inkjet printer 10 performs printing on print media 90 on the basis of the print data by controlling the plurality of inkjet heads 24 for color ink, the two inkjet heads 25 for clear ink, the two LED lamps 26, the ultraviolet lamp 27, the carriage driving device 44, and the medium conveyance device 21.

Hereinafter, printing on a print medium 90 will be described in detail.

If attention is focused on a specific area of the print medium 90, the printing controller 46*a* performs printing on the print medium 90 by the following individual processes.

FIG. 5(*a*) is a cross-sectional view of the specific area of the print medium 90 in a case where a color ink ejecting process is being performed. FIG. 5(*b*) is a cross-sectional view of the area of the print medium 90 shown in FIG. 5(*a*) in a case where a color ink hardening process is being performed. FIG. 5(*c*) is a cross-sectional view of the area of the print medium 90 shown in FIG. 5(*b*) in a case where a clear-ink ejecting process is being performed. FIG. 5(*d*) is a cross-sectional view of the area of the print medium 90 shown in FIG. 5(*c*) in a case where a clear-ink hardening process is being performed.

<Color Ink Ejecting Process>

First, the printing controller 46*a* ejects the color ink toward the print medium 90 by the inkjet heads 24 for color ink, such that the color ink adheres to the print medium 90. Therefore, on the print medium 90, as shown in FIG. 5(*a*), an unhardened color ink layer (hereinafter, referred to as the "unhardened color layer") 61 is formed.

<Color Ink Hardening Process>

Subsequently, the printing controller 46*a* radiates ultraviolet light with a wavelength equal to or longer than 365 nm toward the unhardened color layer 61 having adhered to the print medium 90 by the color ink ejecting process by the LED lamp 26, thereby hardening the unhardened color layer 61. Therefore, on the print medium 90, as shown in FIG. 5(*b*), a hardened color ink layer (hereinafter, referred to as the "hardened color layer") 62 is formed. Also, it is preferable that the color ink hardening process be a process of radiating ultraviolet light toward the unhardened color layer 61 made of the color ink having adhered to the print medium 90 by the color ink ejecting process by the LED lamp 26, when the carriage 23 performs scanning for the color ink ejecting process in the main scan directions shown by the arrow 10*a*.

<Clear-Ink Ejecting Process>

Subsequently, the printing controller 46*a* ejects the clear ink toward the hardened color layer 62 hardened by the color ink hardening process, by the inkjet heads 25 for clear ink, such that the clear ink adheres to the hardened color layer 62. Therefore, on the print medium 90, as shown in FIG. 5(*c*), an unhardened clear-ink layer (hereinafter, referred to as the "unhardened clear layer") 63 is formed so as to overlap the hardened color layer 62.

<Post-Clear-Ink-Ejection Moving Process>

Subsequently, the printing controller 46*a* moves the print medium 90 in the direction shown by the arrow 10*c* by driving the medium conveyance device 21 until the unhardened clear layer 63 having adhered to the hardened color layer 62 by the clear-ink ejecting process and the ultraviolet lamp 27 come into a state where they face each other.

<Clear-Ink Hardening Process>

Finally, in a case where the unhardened clear layer 63 having adhered to the hardened color layer 62 by the clear-ink ejecting process and the ultraviolet lamp 27 have come into a state where they face each other by the post-clear-ink-ejection moving process, the printing controller 46*a* radiates ultraviolet light having a wavelength shorter than 365 nm toward the unhardened clear layer 63 by the ultraviolet lamp 27, thereby hardening the unhardened clear layer 63. Therefore, on the print medium 90, as shown in FIG. 5(*d*), a hardened clear ink layer (hereinafter, referred to as the "hardened clear layer") 64 is formed so as to overlap the hardened color layer 62.

Although the above description has been made with focus on the specific area of the print medium 90, actually, the individual processes can be simultaneously performed on a plurality of areas of a print medium 90 as will be described below.

Figure 6:
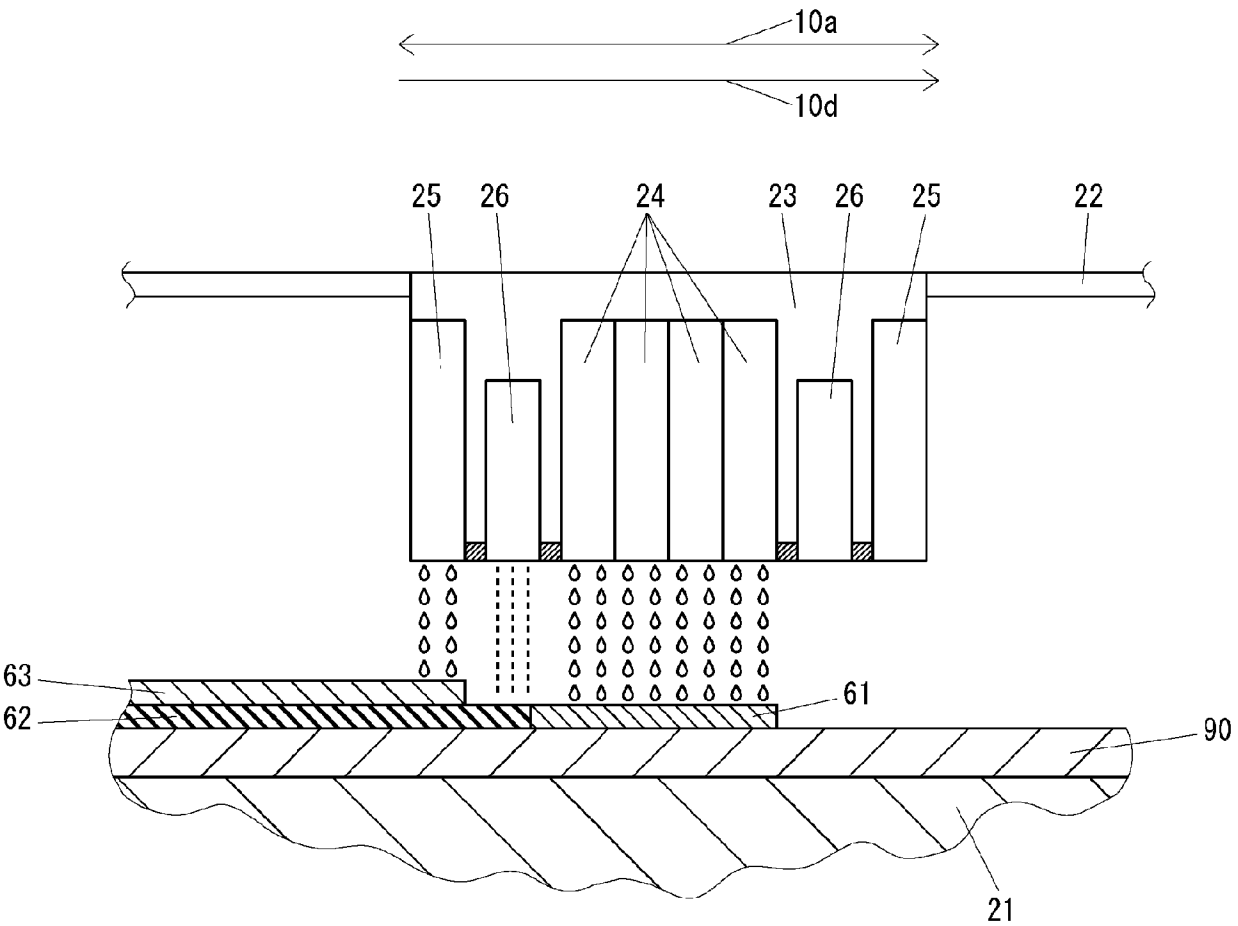
FIG. 6 is a sectional front view of a portion of the inkjet printer shown in FIG. 1 in a case where the color ink ejecting process, the color ink hardening process, and the clear-ink ejecting process are being simultaneously performed on a plurality of areas of a print medium existing in a main scan direction.

FIG. 6 is a sectional front view of a portion of the inkjet printer 10 in a case where the color ink ejecting process, the color ink hardening process, and the clear-ink ejecting process are being simultaneously performed on a plurality of areas of a print medium 90 existing in the main scan directions shown by the arrow 10*a*.

The printing controller 46*a* controls the carriage driving device 44, thereby moving the carriage 23 along the guide rail 22 in the main scan directions shown by the arrow 10*a*, thereby relatively moving the inkjet heads 24 for color ink, the inkjet heads 25 for clear ink, and the LED lamps 26 mounted on the carriage 23, in the main scan directions with respect to the print medium 90. At this time, the printing controller 46*a* performs the color ink ejecting process on the individual areas existing in the main scan directions, by controlling the inkjet heads 24 for color ink such that the inkjet heads eject the color ink toward the print medium 90. Also, the printing controller 46*a* performs the color ink hardening process on the individual areas existing in the main scan directions, by controlling the LED lamps 26 such that the LED lamps radiate ultraviolet light toward the print medium 90. Further, the printing controller 46*a* performs the clear-ink ejecting process on the individual areas existing in the main scan directions, by controlling the inkjet heads 25 for clear ink such that the inkjet heads eject the clear ink toward the print medium 90. In other words, the printing controller 46*a* simultaneously performs the color ink ejecting process, the color ink hardening process, and the clear-ink ejecting process on a plurality of areas of the print medium 90 existing in the main scan directions, as shown in FIG. 6.

In the color ink hardening process which is performed on the individual areas existing in the main scan directions shown by the arrow 10*a*, the printing controller 46*a* needs to use the LED lamps 26 disposed on the upstream side from the inkjet heads 24 for color ink in the movement direction of the carriage 23 relative to the print medium 90 which is one of the main scan directions, that is, in a direction shown by an arrow 10*d* in an example shown in FIG. 6. By performing control as described above, the printing controller 46*a* can perform the color ink ejecting process and the color ink hardening process on the individual areas existing in the main scan directions as the carriage 23 moves along both of one direction of the main scan directions and the other direction with respect to the print medium 90 once. Further, even in the clear-ink ejecting process which is performed on individual areas existing in the main scan directions, the printing controller 46*a* needs to use the inkjet heads 25 for clear ink disposed on the upstream side from the LED lamps 26 disposed on the upstream side from the inkjet heads 24 for color ink, in the movement direction of the carriage 23 relative to the print medium 90 which is one of the main scan directions, that is, in the direction shown by the arrow 10*d* in an example shown in FIG. 6. By performing control as described above, the printing controller 46*a* can perform the color ink ejecting process, the color ink hardening process, and the clear-ink ejecting process on individual areas existing in the main scan directions as the carriage 23 moves along both of one direction of the main scan directions and the other direction with respect to the print medium 90 once.

If finishing performance of the color ink ejecting process, the color ink hardening process, and the clear-ink ejecting process on the individual areas existing in the main scan directions shown by the arrow 10*a*, the printing controller 46*a* moves the print medium 90 in the direction shown by the arrow 10*c*, to the next printing position in the direction shown by the arrow 10*c*, by driving the medium conveyance device 21. Then, the printing controller 46*a* performs the color ink ejecting process, the color ink hardening process, and the clear-ink ejecting process on individual areas existing in the main scan directions at the new printing position. The printing controller 46*a* can perform the color ink ejecting process, the color ink hardening process, and the clear-ink ejecting process on the entire area of the print medium 90 by repeating the above described operations.

Therefore, if the printing controller 46*a* repeats an operation of moving the print medium 90 in the direction shown by the arrow 10*c*, to the next printing position in the direction shown by the arrow 10*c*, a plurality of times, the unhardened clear layer 63 having adhered to the hardened color layer 62 by the clear-ink ejecting process and the ultraviolet lamp 27 come into a state where they face each other. In other words, the operation of the printing controller 46*a* to move the print medium 90 to the next printing position in the direction shown by the arrow 10*c* may also serve as the post-clear-ink-ejection moving process.

Figure 7:
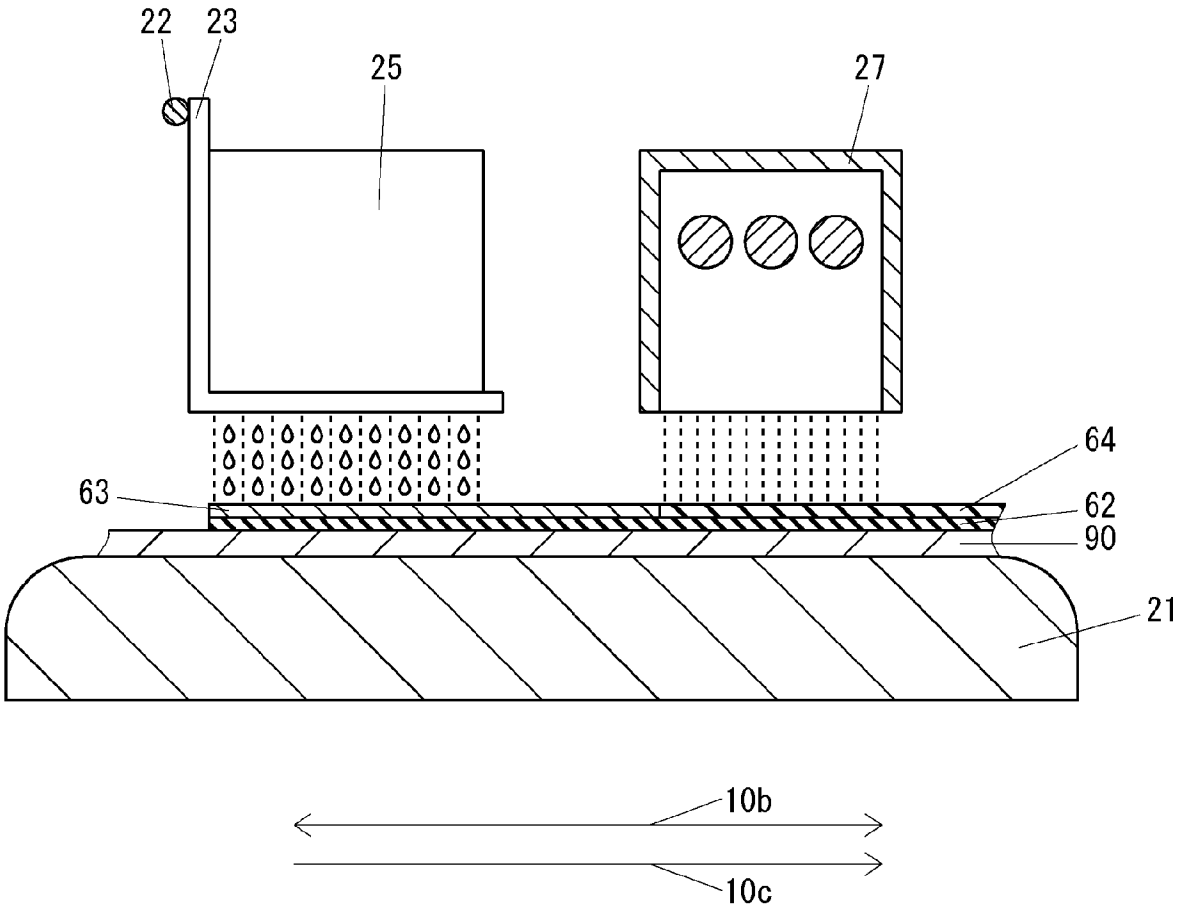
FIG. 7 is a sectional side view of a portion of the inkjet printer shown in FIG. 1 in a case where the color ink ejecting process, the color ink hardening process, the clear-ink ejecting process, and the clear-ink hardening process are being simultaneously performed on a plurality of areas of a print medium existing in a sub scan direction.

FIG. 7 is a sectional side view of a portion of the inkjet printer 10 in a case where the color ink ejecting process, the color ink hardening process, the clear-ink ejecting process, and the clear-ink hardening process are being simultaneously performed on a plurality of areas of a print medium 90 existing in the sub scan directions shown by the arrow 10*b*.

In a case where the print medium 90 faces all of the inkjet heads 24 for color ink, the inkjet heads 25 for clear ink, the LED lamps 26, and the ultraviolet lamp 27 at the same time, the printing controller 46*a* can simultaneously perform the color ink ejecting process, the color ink hardening process, the clear-ink ejecting process, and the clear-ink hardening process on a plurality of areas of the print medium 90 existing in the sub scan directions shown by the arrow 10*b*, as shown in FIG. 7.

As described above, the inkjet printer 10 hardens the unhardened clear layer 63 by ultraviolet light radiated by the ultraviolet lamp 27 configured to radiate ultraviolet light capable of hardening the clear ink, not by ultraviolet light radiated by the LED lamps 26 configured to radiate ultraviolet light capable of hardening the color ink, and thus can use clear ink containing a photoinitiator sensitive for ultraviolet light having short wavelengths shorter than 365 nm, such as ultraviolet light having a short wavelength such as 254 nm. Here, in a case where ink contains a photoinitiator sensitive for ultraviolet light belonging to the long-wavelength side (wavelengths equal to or longer than 365 nm), the ink is likely to yellow; whereas in a case where ink contains a photoinitiator sensitive for ultraviolet light belonging to the short-wavelength side (wavelengths shorter than 365 nm), the ink is unlikely to yellow. In other words, in a case where the clear ink contains a photoinitiator sensitive for ultraviolet light having short wavelengths shorter than 365 nm is hardened by ultraviolet light, the clear ink is unlikely to yellow. Therefore, the inkjet printer 10 can reduce yellowing of a coating formed of the hardened clear layer 64 with respect to printing using the hardened color layer 62 on the print medium 90, as compared to the related art.

In the inkjet printer 10, since the inkjet heads 25 for clear ink and the ultraviolet lamp 27 are separately disposed in the sub scan directions shown by the arrow 10*b*, in a period from when the unhardened clear layer 63 has adhered to the hardened color layer 62 by the inkjet heads 25 for clear ink to when the unhardened clear layer 63 is hardened by the ultraviolet lamp 27, it is required a time for the medium conveyance device 21 to move the print medium 90 until the unhardened clear layer 63 having adhered to the hardened color layer 62 by the inkjet heads 25 for clear ink and the ultraviolet lamp 27 come into a state where they face each other. For this reason, during this movement time, the leveling property of the unhardened clear layer 63 having adhered to the hardened color layer 62 improves. Therefore, the inkjet printer 10 can improve the glossiness of the coating formed of the hardened clear layer 64 with respect to printing using the hardened color layer 62 on the print medium 90.

Here, in a case of radiating ultraviolet light toward the unhardened color layer 61 formed of the color ink having adhered to the print medium 90 by the color ink ejecting process, by the LED lamps 26 in the color ink hardening process, when the carriage 23 performs scanning for the color ink ejecting process in the main scan directions shown by the arrow 10*a*, the inkjet printer 10 immediately hardens the color ink having adhered to the print medium 90 by the color ink ejecting process, in the color ink hardening process, and thus can suppress bleeding of the color ink. Therefore, the inkjet printer 10 can improve the glossiness of the coating made of the clear ink with respect to printing on the print medium 90 with the color ink while suppressing bleeding during printing on the print medium 90 with the color ink.

Also, the inkjet printer 10 may not have the ultraviolet lamp 27, and an ultraviolet lamp for radiating ultraviolet light capable of hardening the clear ink ejected by the inkjet heads 25 for clear ink may be mounted on the carriage 23. However, in case of this configuration, in a period from when the unhardened clear layer 63 has adhered to the hardened color layer 62 by the inkjet heads 25 for clear ink to when the unhardened clear layer 63 is hardened by ultraviolet light, a standby time for improving the leveling property of the unhardened clear layer 63 is required. In other words, in the case where the inkjet printer 10 has an ultraviolet lamp mounted on the carriage 23, without having the ultraviolet lamp 27, a total time for printing using the hardened color layer 62 and the hardened clear layer 64 becomes longer as compared to the configuration having the ultraviolet lamp 27.

In the inkjet printer 10, since lamps for color ink are the LED lamps 26, it is possible to reduce the weight of the lamps for color ink as compared to a case where the lamps for color ink are other lamps such as high-pressure mercury lamps or metal halide lamps. Therefore, the inkjet printer 10 can reduce the size of a drive device for moving the carriage 23 with the lamps for color ink mounted thereon, and can reduce the size of the whole of the inkjet printer 10.

In the inkjet printer 10, in a case where the lamps for color ink which are mounted on the carriage 23 are high-pressure mercury lamps or metal halide lamps, since the high-pressure mercury lamps or the metal halide lamps have directivity lower than that of LED lamps, as compared to the configuration in which the lamps for color ink which are mounted on the carriage 23 are the LED lamps 26, after ultraviolet light which is radiated by the high-pressure mercury lamps or metal halide lamps mounted as the lamps for color ink on the carriage 23 is reflected by the individual units of the inkjet printer 10, a print medium 90, and the like, it is likely to reach the nozzles of the inkjet heads 24 for color ink and the inkjet heads 25 for clear ink mounted on the carriage 23. Therefore, in the inkjet printer 10, in the case where the lamps for color ink which are mounted on the carriage 23 are high-pressure mercury lamps or metal halide lamps, as compared to the configuration in which the lamps for color ink which are mounted on the carriage 23 are the LED lamps 26, the nozzles of the inkjet heads 24 for color ink and the inkjet heads 25 for clear ink mounted on the carriage 23 are likely to be clogged by hardening of the ink by ultraviolet light. Meanwhile, in the inkjet printer 10, in the case where the lamps for color ink which are mounted on the carriage 23 are the LED lamps 26, clogging of the nozzles as described above is unlikely to occur.

In the inkjet printer 10, in a case where the LED lamps 26 radiate ultraviolet light having a wavelength equal to or longer than 385 nm, since the color ink contains the photoinitiator sensitive for ultraviolet light having wavelengths equal to or longer than 385 nm, the color ink is likely to yellow. However, since the color ink has colors from the beginning, its yellowing is more inconspicuous as compared to the clear ink. Therefore, even if the inkjet printer 10 has the LED lamps 26 configured to radiate ultraviolet light having a wavelength equal to or longer than 385 nm as the lamps for color ink, it is possible to suppress deterioration in the quality of printing using the color ink.

The clear-ink hardening process of the inkjet printer 10 may be a process of hardening the clear ink by ultraviolet light with a wavelength equal to or shorter than 320 nm radiated toward the clear ink by the ultraviolet lamp 27. According to this configuration, in the inkjet printer 10, since the clear ink contains the photoinitiator sensitive for ultraviolet light with wavelengths equal to or shorter than 320 nm, and from among a plurality of peaks with the wavelength of ultraviolet light which is radiated by a high-pressure mercury lamp or a metal halide lamp which is used as the ultraviolet lamp 27, peaks with a wavelength equal to or shorter than 320 nm is used to harden the clear ink, it is possible to reduce yellowing of the coating formed of the clear ink with respect to printing on a print medium 90 with the color ink. For example, since peaks with the wavelengths of ultraviolet light which is radiated by a metal halide lamp exist between 300 nm and 380 nm, in a case of using a metal halide lamp as the ultraviolet lamp 27, the inkjet printer 10 can use peaks with a wavelength equal to or shorter than 320 nm, that is, peaks with 300 nm, from among peaks with the wavelengths of ultraviolet light which is radiated by the metal halide lamp.

If it is assumed that the inkjet printer 10 has a configuration for moving the ultraviolet lamp in directions intersecting with the direction shown by the arrow 10*c*, that is, the main scan directions shown by the arrow 10*a*, with respect to the print medium 90, over a width equal to or longer than the width of the clear ink which adheres to the color ink by the clear-ink ejecting process, since areas which are included in the unhardened clear layer 63 having adhered to the hardened color layer 62 and toward which ultraviolet light is intensively radiated by the ultraviolet lamp, that is, areas which are quickly hardened move with movement of the ultraviolet lamp relative to the print medium 90 in the main scan directions, movement of the ultraviolet lamp causes optical stripes on the hardened clear layer 64 having adhered to the hardened color layer 62. However, since the inkjet printer 10 has a configuration in which the ultraviolet lamp 27 extends in the main scan directions over a width equal to or longer than the width of the clear ink which adheres to the color ink by the clear-ink ejecting process, it is unnecessary to move the ultraviolet lamp 27 in the main scan directions with respect to the print medium 90. For this reason, the inkjet printer 10 can suppress optical stripes from being generated on the hardened clear layer 64 having adhered to the hardened color layer 62. Therefore, the inkjet printer 10 can improve the glossiness of the coating formed of the hardened clear layer 64 with respect to printing using the hardened color layer 62 on the print medium 90.

Also, the inkjet printer 10 may not have the ultraviolet lamp 27 and may have a configuration for moving an ultraviolet lamp configured to radiate ultraviolet light capable of hardening the clear ink ejected by the inkjet heads 25 for clear ink, at the position of the ultraviolet lamp 27 in the sub scan directions shown by the arrow 10*b*, in the main scan directions shown by the arrow 10*a*, with respect to the print medium 90 over a width equal to or longer than the width of the clear ink which adheres to the color ink by the clear-ink ejecting process.

As described above, in order to perform the color ink ejecting process and the color ink hardening process on individual areas existing in the main scan directions as the carriage 23 moves in both of one direction of the main scan directions shown by the arrow 10*a* and the other direction with respect to each print medium 90 once, the inkjet printer 10 has the two LED lamps 26 disposed on both sides of the group of the plurality of inkjet heads 24 for color ink in the main scan directions. However, in a case where the inkjet printer 10 has a configuration for performing the color ink ejecting process and the color ink hardening process on individual areas existing in the main scan directions as the carriage 23 moves only in one direction of the main scan directions with respect to each print medium 90, or as the carriage 23 moves in the main scan directions with respect to each print medium 90, a plurality of times, it may have only one LED lamp 26.

Similarly, as described above, in order to perform the color ink ejecting process, the color ink hardening process, and the clear-ink ejecting process on individual areas existing in the main scan directions as the carriage 23 moves in both of one direction of the main scan directions shown by the arrow 10*a* and the other direction with respect to each print medium 90 once, the inkjet printer 10 has the two inkjet heads 25 for clear ink disposed on both sides of the group of the plurality of inkjet heads 24 for color ink and the two LED lamps 26 in the main scan directions. However, in a case where the inkjet printer 10 has a configuration for performing the color ink ejecting process, the color ink hardening process, the clear-ink ejecting process on individual areas existing in the main scan directions as the carriage 23 moves only in one direction of the main scan directions with respect to each print medium 90, or as the carriage 23 moves in the main scan directions with respect to each print medium 90, a plurality of times, it may have only one LED lamp 26.

Figure 8:
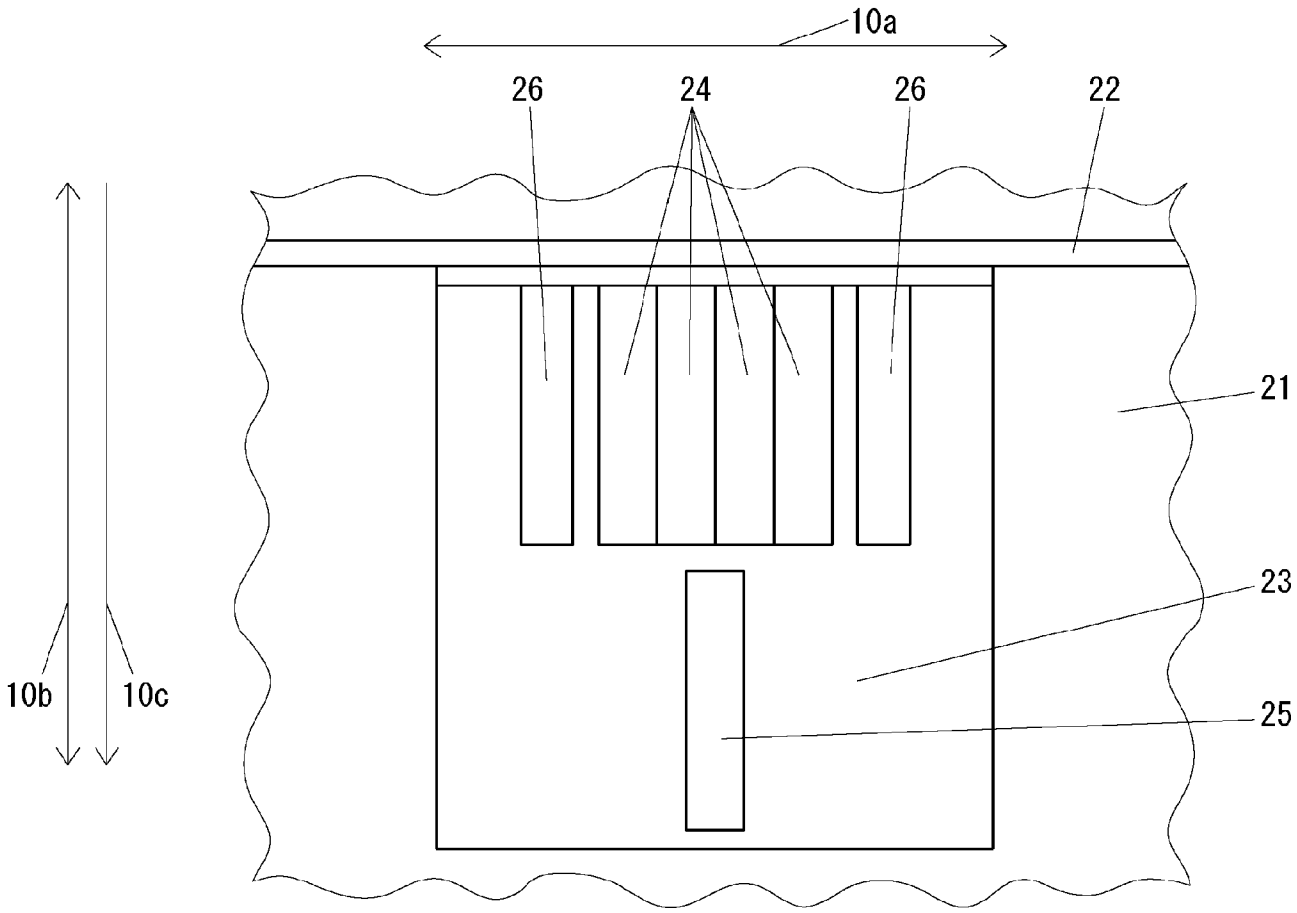
FIG. 8 is a plan view of a portion of the inside of a main body of an inkjet printer in an example different from an example shown in FIG. 3.
Figure 9:
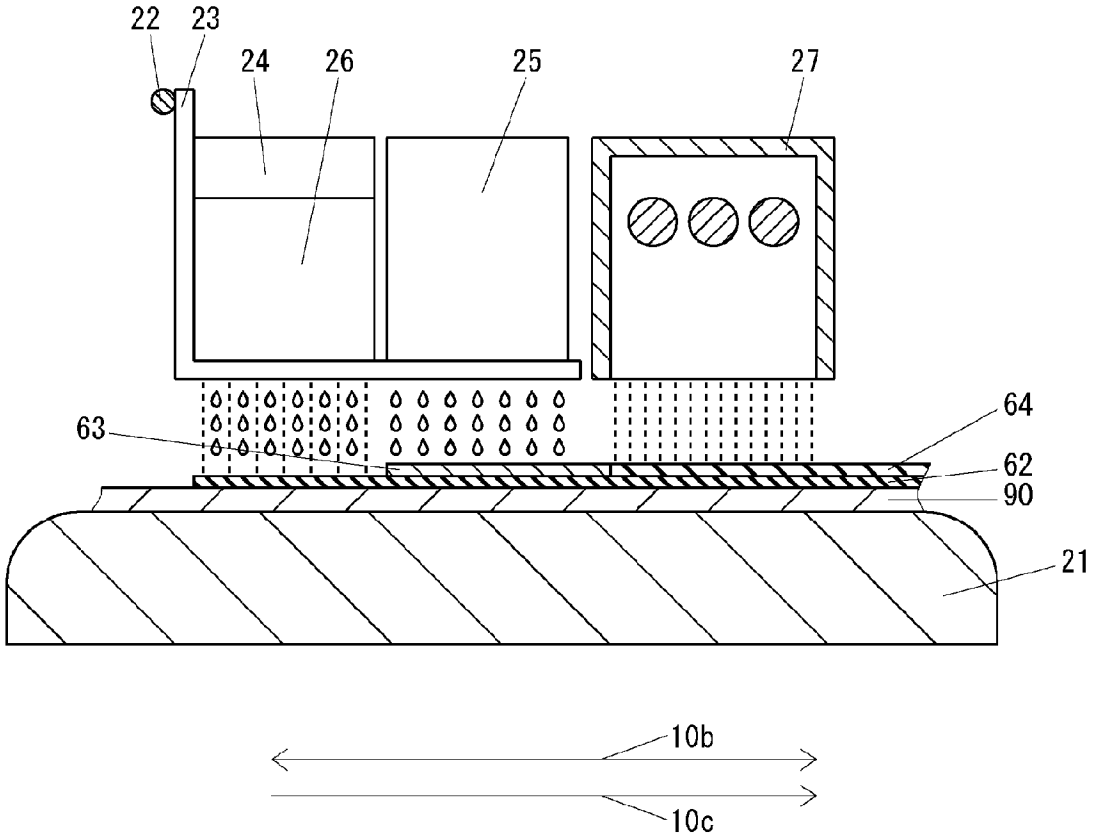
FIG. 9 is a sectional side view of a portion of an inkjet printer in a case where a color ink ejecting process, a color ink hardening process, a clear-ink ejecting process, and a clear-ink hardening process are being simultaneously performed on a plurality of areas of a print medium existing along a sub scan direction, in an example different from an example shown in FIG. 7.

As described above, since the inkjet heads 24 for color ink and the inkjet heads 25 for clear ink are disposed side by side in the main scan directions shown by the arrow 10*a* as shown in FIG. 3, the inkjet printer 10 can simultaneously perform the color ink ejecting process and the clear-ink ejecting process on a plurality of areas of a print medium 90 existing side by side in the main scan directions. However, in the inkjet printer 10, the inkjet heads 24 for color ink may be disposed so as to be deviated from the inkjet heads 25 for clear ink in the sub scan directions shown by the arrow 10*b* as shown in FIG. 8. In the case where the inkjet heads 24 for color ink may be disposed so as to be deviated from the inkjet heads 25 for clear ink in the sub scan directions, the inkjet printer 10 may have only one inkjet head 25 for clear ink. In case of the configuration shown in FIG. 8, the inkjet printer 10 can simultaneously perform the color ink ejecting process, the color ink hardening process, and the clear-ink ejecting process on a plurality of areas of the print medium 90 positioned separately in the sub scan directions, as shown in FIG. 9.

As described above, in the color ink hardening process, the inkjet printer 10 completely hardens the unhardened color layer 61 by the LED lamps 26. However, the inkjet printer 10 may temporarily harden the unhardened color layer 61 by the LED lamps 26 in the color ink hardening process, and completely harden the unhardened color layer 61 in the clear-ink hardening process while hardening the unhardened clear layer 63. According to this configuration, since the inkjet printer 10 needs only to temporarily harden the unhardened color layer 61 by the LED lamps 26, as compared to the configuration for completely hardening the unhardened color layer 61 by the LED lamps 26, it is possible to reduce the accumulated amount of ultraviolet light which the LED lamps 26 radiate toward the unhardened color layer 61. Therefore, as compared to the configuration for completely hardening the unhardened color layer 61 by the LED lamps 26, the inkjet printer 10 can reduce a time which is required for the LED lamps 26 to radiate ultraviolet light toward the unhardened color layer 61, thereby reducing a total time for printing using the hardened color layer 62 and the hardened clear layer 64, and reduce the intensity of ultraviolet light which the LED lamps 26 radiate toward the unhardened color layer 61, thereby saving electric power.

In the present embodiment, the inkjet printer 10 has a configuration for relatively moving the inkjet heads 24 for color ink, the inkjet heads 25 for clear ink, the LED lamps 26, and the ultraviolet lamp 27 in the sub scan directions with respect to each print medium 90 by conveying each print medium 90 in the sub scan directions shown by the arrow 10*b*; however, it may have a configuration other than this configuration. For example, the inkjet printer 10 may have a configuration for relatively moving the inkjet heads 24 for color ink, the inkjet heads 25 for clear ink, the LED lamps 26, and the ultraviolet lamp 27 in the directions shown by the arrow 10*b*, with respect to each print medium 90, by moving the inkjet heads 24 for color ink, the inkjet heads 25 for clear ink, the LED lamps 26, and the ultraviolet lamp 27 in the sub scan directions.

Also, the specific numerical values of the wavelengths described above are examples. As long as ultraviolet light which is radiated by the LED lamps 26 can harden the color ink, arbitrary wavelengths can be used. Similarly, as long as ultraviolet light which is radiated by the ultraviolet lamp 27 can harden the clear ink, arbitrary wavelengths can be used.

Also, the lamps for color ink according to the disclosure are the LED lamps 26 in the present embodiment; however, they may not be LED lamps as long as they radiate ultraviolet light capable of hardening the color ink. Similarly, the lamp for clear ink according to the disclosure is the ultraviolet lamp 27 in the present embodiment; however, it may not be an ultraviolet lamp as long as it radiates ultraviolet light capable of the clear ink.

The invention claimed is:

1. An inkjet printer comprising:

an inkjet head for color ink configured to eject ultraviolet curing type color ink;

an inkjet head for clear ink configured to eject ultraviolet curing type clear ink, wherein the clear ink contains a photoinitiator which generates radicals by ultraviolet light with a wavelength equal to or shorter than 320 nm;

a lamp for color ink configured to radiate ultraviolet light capable of hardening the color ink;

a lamp for clear ink configured to radiate ultraviolet light capable of hardening the clear ink; and a printing controller configured to control printing on a print medium, wherein the printing controller performs a color ink ejecting process of ejecting the color ink toward the print medium by the inkjet head for color ink, a color ink hardening process of radiating ultraviolet light toward the color ink having adhered to the print medium by the color ink ejecting process, by the lamp for color ink, a clear-ink ejecting process of ejecting the clear ink toward the color ink hardened by the color ink hardening process, by the inkjet head for clear ink, and a clear-ink hardening process of radiating ultraviolet light toward the clear ink having adhered to the color ink by the clear-ink ejecting process, by the lamp for clear ink, the color ink hardening process is a process of hardening the color ink by ultraviolet light with a wavelength equal to or longer than 365 nm radiated toward the color ink by the lamp for color ink, and the clear-ink hardening process is a process of hardening the clear ink by ultraviolet light with the wavelength equal to or shorter than 320 nm radiated toward the clear ink by the lamp for clear ink.

2. The inkjet printer according to claim 1, wherein:

the color ink hardening process is a process of temporarily hardening the color ink by radiating ultraviolet light toward the color ink having adhered to the print medium by the color ink ejecting process, by the lamp for color ink, and the clear-ink hardening process is a process in which not only the clear ink is hardened, the color ink is also completely hardened by radiating ultraviolet light toward the clear ink having adhered to the color ink by the clear-ink ejecting process, by the lamp for clear ink.

3. The inkjet printer according to claim 1, wherein:

the lamp for clear ink extends in a direction intersecting with a specific direction, over a width equal to or longer than the width of the clear ink which adheres to the color ink by the clear-ink ejecting process.

4. The inkjet printer according to claim 1, wherein:

the lamp for clear ink is a high-pressure mercury lamp or a metal halide lamp.

5. The inkjet printer according to claim 4, wherein:

the lamp for clear ink extends in a direction intersecting with a specific direction, over a width equal to or longer than the width of the clear ink which adheres to the color ink by the clear-ink ejecting process.

6. The inkjet printer according to claim 1, further comprising:

a moving mechanism configured to relatively move the print medium in a specific direction with respect to the inkjet head for color ink, the inkjet head for clear ink, the lamp for color ink, and the lamp for clear ink, wherein the lamp for clear ink is disposed on a downstream side from the inkjet head for clear ink in the specific direction, the printing controller performs a post-clear-ink-ejection moving process of driving the moving mechanism until the clear ink having adhered to the color ink by the clear-ink ejecting process and the lamp for clear ink come into a state where they face each other, and the clear-ink hardening process is a process of radiating ultraviolet light toward the clear ink by the lamp for clear ink in a case where the clear ink having adhered to the color ink by the clear-ink ejecting process and the lamp for clear ink have come into a state where they face each other by the post-clear-ink-ejection moving process.

7. The inkjet printer according to claim 6, wherein:

the lamp for clear ink is a high-pressure mercury lamp or a metal halide lamp.

8. The inkjet printer according to claim 6, wherein:

the lamp for clear ink extends in a direction intersecting with the specific direction, over a width equal to or longer than the width of the clear ink which adheres to the color ink by the clear-ink ejecting process.

9. The inkjet printer according to claim 6, wherein:

the color ink hardening process is a process of temporarily hardening the color ink by radiating ultraviolet light toward the color ink having adhered to the print medium by the color ink ejecting process, by the lamp for color ink, and the clear-ink hardening process is a process in which not only the clear ink is hardened, the color ink is also completely hardened by radiating ultraviolet light toward the clear ink having adhered to the color ink by the clear-ink ejecting process, by the lamp for clear ink.

10. The inkjet printer according to claim 6, further comprising:

a carriage movable in a direction intersecting with the specific direction, wherein the inkjet head for color ink, the inkjet head for clear ink, and the lamp for color ink are mounted on the carriage, and the color ink hardening process is a process of radiating ultraviolet light toward the color ink having adhered to the print medium by the color ink ejecting process, by the lamp for color ink, when the carriage performs scanning for the color ink ejecting process in the direction intersecting with the specific direction.

11. The inkjet printer according to claim 10, wherein:

the lamp for clear ink is a high-pressure mercury lamp or a metal halide lamp.

12. The inkjet printer according to claim 10, wherein:

the lamp for clear ink extends in a direction intersecting with the specific direction, over a width equal to or longer than the width of the clear ink which adheres to the color ink by the clear-ink ejecting process.

13. The inkjet printer according to claim 10, wherein:

the color ink hardening process is a process of temporarily hardening the color ink by radiating ultraviolet light toward the color ink having adhered to the print medium by the color ink ejecting process, by the lamp for color ink, and the clear-ink hardening process is a process in which not only the clear ink is hardened, the color ink is also completely hardened by radiating ultraviolet light toward the clear ink having adhered to the color ink by the clear-ink ejecting process, by the lamp for clear ink.

14. The inkjet printer according to claim 10, wherein:

the lamp for color ink is an LED lamp.

15. The inkjet printer according to claim 14, wherein:

the color ink hardening process is a process of hardening the color ink by ultraviolet light with a wavelength equal to or shorter than 385 nm radiated toward the color ink by the lamp for color ink.

* * * * *